US009617759B2

(12) United States Patent
Kang et al.

(10) Patent No.: US 9,617,759 B2
(45) Date of Patent: Apr. 11, 2017

(54) DOOR HOLDING DEVICE FOR VEHICLE

(71) Applicant: Hyundai Motor Company, Seoul (KR)

(72) Inventors: Kwan Hui Kang, Hwaseong-si (KR); Chang Dong Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 241 days.

(21) Appl. No.: 14/283,769

(22) Filed: May 21, 2014

(65) Prior Publication Data

US 2015/0123410 A1 May 7, 2015

(30) Foreign Application Priority Data

Nov. 6, 2013 (KR) ..... 10-2013-0134114

(51) Int. Cl.

| | |
|---|---|
| ***E05B 3/00*** | (2006.01) |
| ***E05B 77/04*** | (2014.01) |
| ***E05B 77/06*** | (2014.01) |
| ***E05B 85/16*** | (2014.01) |

(52) U.S. Cl.

CPC ..... *E05B 77/04* (2013.01); *E05B 77/06* (2013.01); *E05B 85/16* (2013.01); *Y10T 292/57* (2015.04)

(58) Field of Classification Search

CPC ..... E05B 77/02; E05B 77/04; E05B 77/06; E05B 85/10; E05B 85/14; E05B 85/16; E05B 85/18

USPC ..... 292/336.3, DIG. 22, DIG. 65, DIG. 23

See application file for complete search history.

(56) References Cited

U.S. PATENT DOCUMENTS

| | | | | |
|---|---|---|---|---|
| 5,669,642 | A * | 9/1997 | Kang | E05B 77/06 292/336.3 |
| 2013/0234455 | A1* | 9/2013 | Rocci | E05B 85/16 292/336.3 |
| 2015/0322699 | A1* | 11/2015 | Ilardo | E05B 77/06 292/336.3 |
| 2016/0069104 | A1* | 3/2016 | Ilardo | B60J 5/0493 292/336.3 |

FOREIGN PATENT DOCUMENTS

| | | | | |
|---|---|---|---|---|
| FR | EP 1586727 | A1 * | 10/2005 | E05B 77/02 |
| JP | 2009-243101 | A | 10/2009 | |
| JP | 2009-256961 | A | 11/2009 | |
| KR | 10-2005-0047984 | A | 5/2005 | |
| KR | 10-2009-0130569 | A | 12/2009 | |
| KR | 10-2011-0032508 | A | 3/2011 | |

OTHER PUBLICATIONS

Computer Generated Translation for EP 1586727, generated using http://worldwide.espacenet.com, generated on Sep. 15, 2016.*

* cited by examiner

*Primary Examiner* — Alyson M Merlino

(74) *Attorney, Agent, or Firm* — Morgan, Lewis & Bockius LLP

(57) ABSTRACT

A door holding device for a vehicle, may include a door handle having a first side disposed on a door base turnably and a second side in which a holder extending inwardly of the door base may be formed, a door lever hinged to the door base and having a guide that may be locked to the holder of the door handle so as to turn with the door handle, and a blocking lever disposed on the door base turnably by a hinge shaft and having a stopper formed to correspond to turning tracks of the holder of the door handle and the guide of the door lever.

6 Claims, 3 Drawing Sheets

DOOR HOLDING DEVICE FOR VEHICLE

CROSS REFERENCE TO RELATED APPLICATION

The present application claims priority of Korean Patent Application Number 10-2013-0134114 filed on Nov. 6, 2013, the entire contents of which is incorporated herein for all purposes by this reference.

BACKGROUND OF THE INVENTION

Field of the Invention

The present invention relates to a door holding device for a vehicle which prevents a door from being opened in the event of a side collision of a vehicle.

Description of Related Art

In general, vehicles are equipped with doors, door handles are mounted on the outer sides of the doors, and the doors are opened/closed by door latches operated by handle cables, which operate when the door handles are operated from the outside.

According to those doors, as shown in FIG. 1, in the event of a side collision of a vehicle, a door handle 2 tends to remain where it is whereas the vehicle 4 rapidly moves in the opposite direction 6 by impact, such that the door handle is moved in the pulling direction, which is its operation direction. Accordingly, since the handle is moved over a predetermined amount in the pulling direction by the movement of the vehicle due to a collision, when the door is not locked, the door opens and a safety accident may occur.

Generally, in most cases, a locking mechanism is applied to a door handle and the door handle is prevented from being opened by the principle of inertia during a collision of a vehicle.

According to the handle locking manner, when the door handle operates along the normal track, the operation of the door handle is restricted by the lock which stops it from moving. However, there is a problem in that the door handle deviates from the normal operation track due to deformation of the door panel by impact due to a side collision of a vehicle, such that the locking effect cannot be performed securely or safely.

Therefore, there is a need of a technology that can ensure reliability and stability against a collision of a vehicle by implementing a door lock structure in a side collision of a vehicle.

The matters described as the related art have been provided only for facilitating the understanding of the background of the present invention and should not be construed as acknowledging them as the prior art already known to those skilled in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door holding device for a vehicle which restricts turning of a door lever to prevent a door from being opened, even when a door handle is not kept locked due to deformation of a door panel by impact applied to a vehicle, by keeping the door handle from being forcibly operated by an external force and by restricting turning of the door lever which opens a door during a collision of the vehicle.

In an aspect of the present invention, a door holding device for a vehicle may include a door handle having a first side disposed on a door base turnably and a second side in which a holder extending inwardly of the door base is formed, a door lever hinged to the door base and having a guide that is locked to the holder of the door handle so as to turn with the door handle, and a blocking lever disposed on the door base turnably by a hinge shaft and having a stopper formed to correspond to turning tracks of the holder of the door handle and the guide of the door lever.

A first locking step protruding in one direction is formed at the holder of the door handle, a second locking step protruding in one direction is formed at the guide of the door lever, and the stopper of the blocking lever may include a first protrusion and a second protrusion corresponding to the first locking step and the second locking step, respectively.

One of the first locking step of the door handle and the second locking step of the door lever further protrude in one direction, and the first protrusion and the second protrusion of the stopper of the blocking lever are formed to cross at a predetermined angle to come in contact with the first locking step and the second locking step while turning.

Free ends of the first locking step and the second locking step of the door handle and the door lever are aligned on a vertical line, and the first protrusion and the second protrusion of the stopper of the blocking lever are formed on a vertical line to come in contact with the first locking step and the second locking step.

A mass providing inertia during a car collision is disposed on the blocking lever.

The mass on the blocking lever is disposed at the second side from the hinge shaft disposed through the blocking lever in order to turn the blocking lever in a same direction as an operation direction of the door handle and the door lever during a car collision.

A first anti-turning portion fixing an initial position in contact with the door base is formed at a first side of the blocking lever, and a second anti-turning portion that restricts turning by being locked to the door base in turning at a predetermined angle in the operation direction is formed at a second side thereof.

At the door base, a first support portion coming in contact with the first anti-turning portion at the initial position of the blocking lever is formed and a second support portion coming in contact with the second anti-turning portion of the blocking lever that may have turned at a predetermined angle is formed.

An elastic member elastically supporting the blocking lever is disposed on the hinge shaft of the door base.

The elastic member is mounted on the hinge shaft of the door base, with a first end in contact with the door base and a second end connected to the blocking lever.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
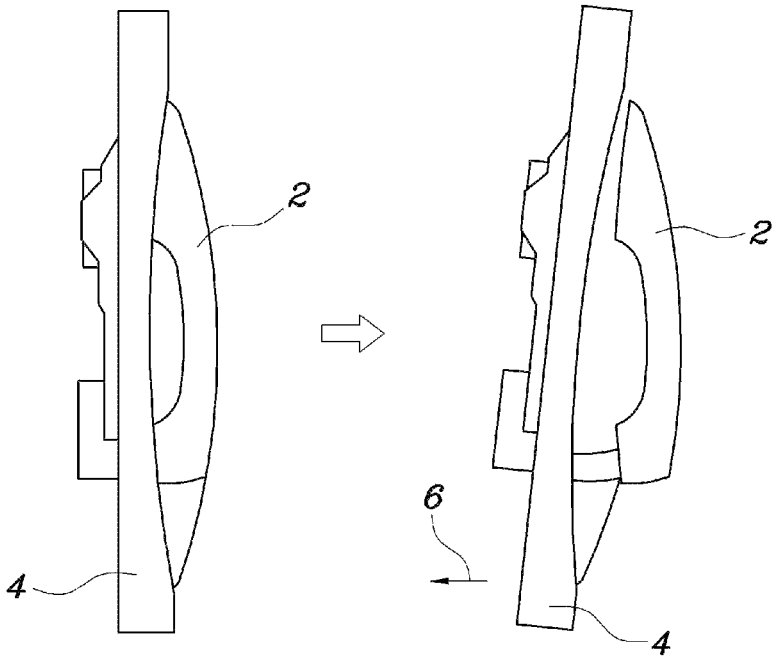
FIG.1 (Related Art)
FIG. 1 is a view illustrating that a door opens during a collision of a vehicle.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a door holding device for a vehicle according to embodiments of the present invention is described hereafter with reference to the accompanying drawings.

Figure 2:
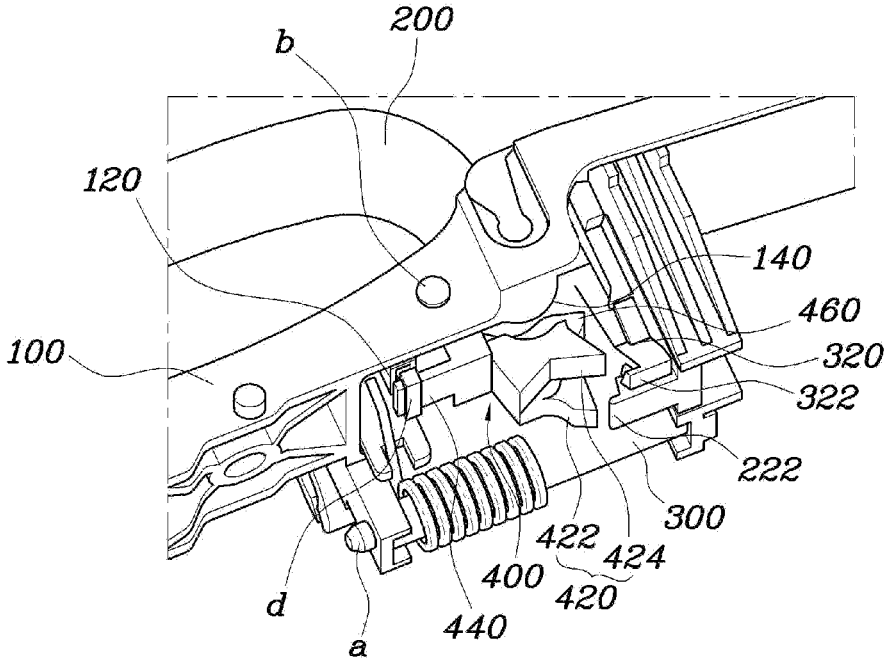
FIG. 2 is a perspective view showing a door holding device for a vehicle according to an exemplary embodiment of the present invention.
Figure 3:
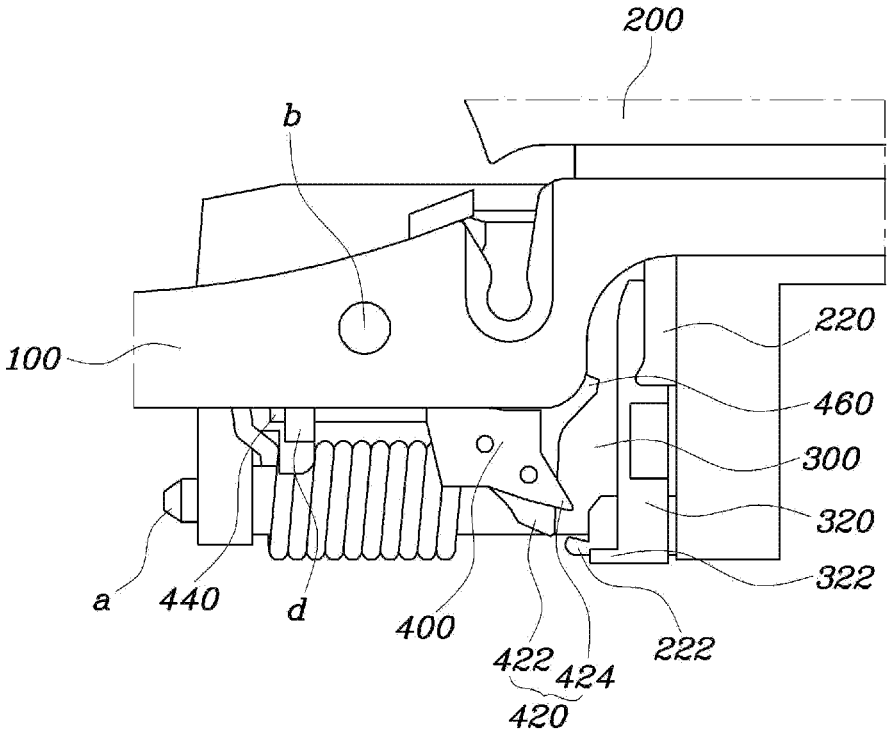
FIG. 3 is a plan view of the door holding device for a vehicle shown in FIG. 2.
Figure 4:
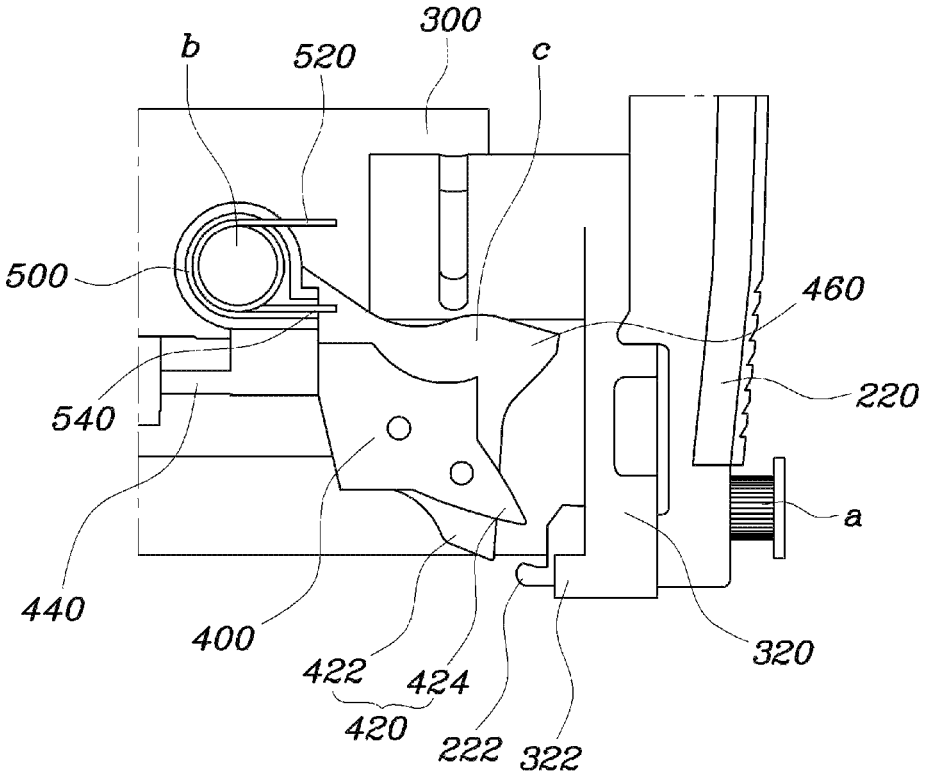
FIGS. 4 and 5 are views illustrating the operation of the door holding device for a vehicle shown in FIG. 2.
Figure 5:
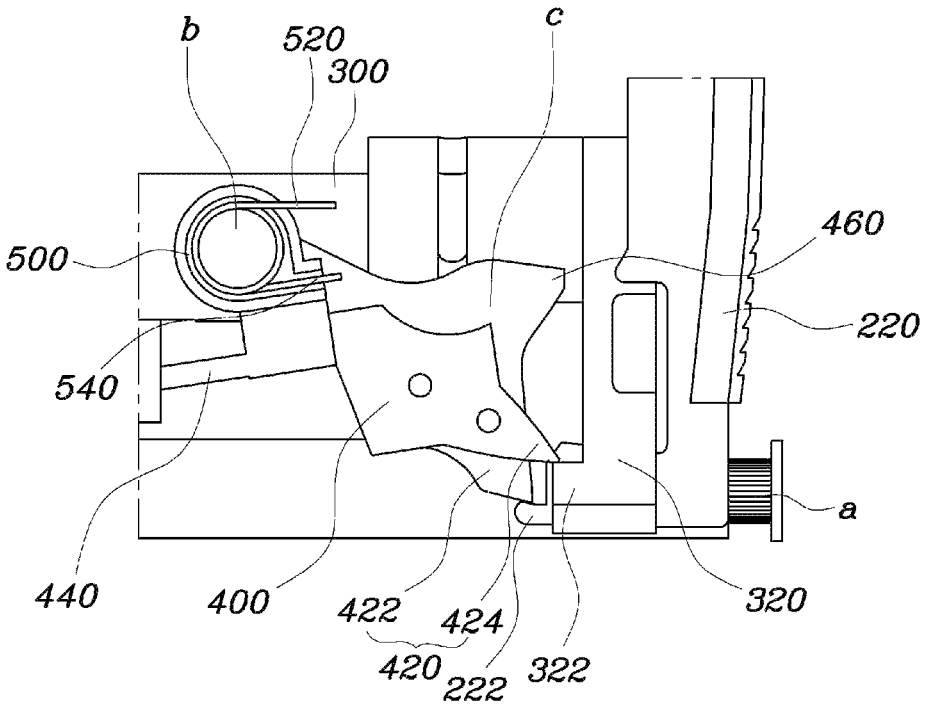

FIG. 2 is a perspective view showing a door holding device for a vehicle according to an exemplary embodiment of the present invention and FIG. 3 is a plan view of the door holding device for a vehicle shown in FIG. 2. The operation state of the door holding device of the present invention is shown in FIGS. 4 and 5. In the description of the present invention, one side and another side mean the left direction and the right direction in FIGS. 2 to 5 and the inner side and the outer side of a door mean the upper direction and the lower direction in the figures. Further, the operation direction in the following description of the present invention device the outward direction from the door in which the door opens.

The door holding device of the present invention includes a door handle 200 having one side coupled to a door base 100 turnably and another side with a holder 220 extending inwardly of the door base 100, a door lever 300 coupled to the door base 100 by a hinge (a), having a guide 320 locked to the holder 220 of the door handle 200, and turning with the door handle 200, a blocking lever 400 turnably coupled to the door base 100 by a hinge shaft (b) and having a stopper 420 formed to correspond to the turning track of the holder 220 of the door handle 200 and the guide 320 of the door lever 300.

The assembly of the door handle 200, the door lever 300, and the blocking lever 400 of the door holding device of the present invention is mounted on the door base 100. The door handle 200, provided for a passenger to open/close a door, is disposed to be able to turn inward from the door base 100 and the door lever 300 is coupled to the door base 100 by the hinge (a) and turns with the door handle 200 in the same direction as the turning direction of the door handle 200, such that a door latch connected with a wire or a rod is operated.

The present invention is designed for preventing a door from being opened by the door handle 200 and the door lever 300 forcibly turned due to impact during a side collision of a vehicle and includes the blocking lever 400 that restricts turning of the door handle 200 and the door lever 300 during a car collision.

Describing the components in detail, the handle 200 is turnably coupled to the door base 100 at one end and has a holder 220 extending inwardly of the door base 100 at another end, so that the holder 220 is connected with the door lever 300 and transmits a force generated by operating the handle.

Further, the door lever 300 coupled to the door base 100 by the hinge (a), having the guide 320 that is locked to the holder 220 of the door handle 200, and turned by operational force from the door handle 200 is provided. As the door handle 200 is operated, the door lever 300 is turned by the coupling structure of the holder 220 and the guide 320, such that it opens/closes a door by operating the door latch.

Since the door handle 200 and the door lever 300 are forcibly turned by inertia that is instantaneously generated during a side collision of a vehicle, the blocking lever 400 for preventing the forced turning is provided.

In the configuration of the present invention, the blocking lever 400 is turnably coupled to the door base 100 by the hinge shaft (b) and the stopper 420 is formed to correspond to the turning track of the holder 220 of the door handle 200 and the guide 320 of the door lever 300 and is turned by its own weight during a car collision.

In a normal state, the blocking lever 400 is not turned with the stopper 420 because it is maintained at a predetermined distance from the holder 220 of the door handle 200 and the guide 320 of the door lever 300 and does not interfere with turning of the door handle 200 and the door lever 300, such that a door is normally opened/closed by a user.

In this state, the blocking lever 400 is turned by inertia due to its own weight during a car collision, but since the stopper 420 is on the turning track of the holder 220 of the door handle 200 and the guide 320 of the door lever 300, it stops the door handle 200 and the door lever 300 from turning in the operation direction, thereby preventing a door from being opened.

In particular, even when the door handle 200 cannot normally turn due to deformation of the door panel by a side collision of a vehicle, the guide 320 of the door lever 300 firmly fixed to the door base 100 is locked to the stopper 420 of the blocking lever 400 and stopped from turning, so it is stably and firmly held and can stably prevent a door from being opened.

Describing the present invention in detail, as can be seen from FIGS. 2 and 3, a first locking step 222 protruding to one side is formed on the holder 220 of the door handle 200, a second locking step 322 protruding to one side is formed on the guide 320 of the door lever 300, and the stopper 420 may include a first protrusion 422 and a second protrusion 424 corresponding to the first locking step 222 and the second locking step 322, respectively.

In an exemplary embodiment of the present invention, the door handle 200 and the door lever 300 are prevented from turning by the blocking lever 400 locking them. That is, the holder 220 extending inwardly of the door handle 200 and the guide 320 of the door lever 300 are connected only for opening/closing a door in the structures of the existing vehicles, but in an exemplary embodiment of the present invention, a door is selectively prevented from being opened by disposing the blocking lever 400 on the door base 100 such that the door handle 200 and the door lever 300 are locked to the blocking lever 400 turned by inertia during a car collision.

To this end, the first locking step 222 protruding in one direction is formed on the holder 220 of the door handle 200 and the second locking step 322 is protrudably formed on the guide 320 of the door lever 300 in the same direction as the first locking step 222 such that the locking steps 222 and 322 of the door handle 200 and the door lever 300 face the blocking lever 400 disposed on the door base 100. The first protrusion 422 and the second protrusion 424 are formed in another direction on the blocking lever 400, corresponding to the first locking step 222 of the door handle 200 and the second locking step 322 of the door lever 300.

The first protrusion 422 and the second protrusion 424 need to be formed in appropriate lengths such that they are not interfered with the first locking step 222 and the second locking step 322 at the initial positions in the normal state and move on the turning tracks of the first locking step 222 and the second locking step 322 when the blocking lever 400 turns due to a car collision.

One of the first locking step 222 of the door handle 200 and the second locking step 322 of the door lever 300 may further protrude in one direction, and in the stopper 420 of the blocking lever 400, the first protrusion 422 and the second protrusion 424 may cross each other at a predetermined direction in order to come in contact with the first locking step 222 and the second locking step 322 when turned.

In another embodiment, the free ends of the first locking step 222 and the second locking step 322 of the door handle 200 and the door lever 300 protrude to be aligned on a vertical line, and the first protrusion 422 and the second protrusion 424 of the stopper 420 of the blocking lever 400 may be formed on a vertical line to come in contact with the first locking step 222 and the second locking step 322.

In an exemplary embodiment of the present invention, the blocking lever 400 should be configured such that the first protrusion 422 and the second protrusion 424 are locked to the first locking step 222 on the holder 220 of the door handle and the second locking step 322 on the guide 320 of the door lever 300 when the blocking lever 400 turns in an operation direction due to a car collision. The first protrusion 422 and the second protrusion 424 of the blocking lever 400 may be formed to cross or be disposed on the vertical line in accordance with the protruding shapes of the first locking step 222 of the door handle 200 and the second locking step 322 of the door lever 300.

For example, since the holder 220 of the door handle 200 is locked to the guide 320 of the door lever 300 in an exemplary embodiment of the present invention, the holder 200 extends at an angle in a predetermined direction to be able to be locked to the guide 320. Accordingly, the holder 220 of the door handle 200 protrudes in the direction further than the guide 320 of the door lever 300, and the first locking step 222 protrudes further than the second locking step 322, as shown in FIG. 3. That is, since the turning tracks of the first locking step 222 and the second locking step 322 differ from each other when the door handle 200 and door lever 300 turn, the first protrusion 422 and the second protrusion 424 of the blocking lever 400 are formed to cross at a predetermined angle so that the first locking step 222 and the second locking step 322 come in contact with the first protrusion 422 and the second protrusion 424, respectively, when turning.

On another hand, as another example, it may be possible to make the first locking step 222 of the door handle 200 and the second locking step 322 of the door lever 300 simultaneously come in contact with the first protrusion 422 and the second protrusion 424 of the blocking lever 400 that has turned due to a car collision, by aligning the free ends of the first locking step 222 of the door handle 200 and the second locking step 322 of the door lever 300 on the vertical line and aligning the first protrusion 422 and the second protrusion 424 of the blocking lever 400 too on a vertical line to correspond to the locking steps 222 and 322, respectively.

In the exemplary embodiments, although the first locking step 222 and the second locking step 322 are configured to accurately come in contact with the first protrusion 422 and the second protrusion 424 of the blocking lever 400 when the door handle 200 and the door lever 300 normally turn, the configuration may be selectively changed in various ways in accordance with the design of vehicles.

A mass (c) providing inertia during a car collision may be disposed on the blocking lever 400.

The mass (c) on the blocking lever 400 may be disposed at another side from the hinge shaft (b) disposed through the blocking lever 400 so that the blocking lever 400 turns in the same direction as the operation direction of the door handle 200 and the door lever 300 during a car collision.

The mass (c), which is a weight balance, may be disposed in the blocking lever 400 and makes the blocking lever 400 turn in the same direction as the operation direction of the door handle 200 and the door lever 300 by giving inertia to the blocking lever 400 in a side collision of a vehicle.

Although the blocking lever 400 can be turned by the inertia due to its own mass during a car collision, the mass (c) is provided in order to make sure that collision inertia due to a car collision is applied to the blocking lever 400, thereby achieving inertial turning during a car collision for sure.

Accordingly, the blocking lever 400 makes sure turning occurs during a car collision, so that the stopper 420 can accurately come in contact with the holder 220 of the door handle 200 and the guide 320 of the door lever 300. The mass (c) can be made in various ways with the weight and shape optimized in accordance with the design of vehicles and collision load tests.

On another hand, as shown in FIG. 2, a first anti-turning portion 440 may be formed at a side of the blocking lever 400 to fix the initial position by coming in contact with the door base 100 and a second anti-turning portion 460 may be formed at another side to restrict turning by being locked to the door base 100 when the blocking lever turns at a predetermined angle in the operation direction.

At the door base 100, a first support portion 120 that comes in contact with the first anti-turning portion 440 at the initial position of the blocking lever 400 may be formed and a second support portion 140 that comes in contact with the second anti-turning portion 460 of the blocking lever 400 that has turned at a predetermined angle may be formed.

That is, in an exemplary embodiment of the present invention, since the blocking lever 400 is turned at a predetermined angle and then fixed to the position during a car collision, it restricts turning of the door handle 200 and the door lever 300 turned during a collision.

Specifically, the first anti-turning portion 440 is formed at a side of the blocking lever 400, the second anti-turning portion 460 is formed at another side, and the first support portion 120 coming in contact with the first anti-turning portion 440 and the second support portion 140 coming in contact with the second anti-turning portion 460 are formed at the door base 100.

First, the first anti-turning portion 440 of the blocking lever 400 extends in one direction to come in contact with the first support portion 120 of the door base 100 and is provided to fix the initial position of the blocking lever 400. The blocking lever 400 may be turned to the first support portion 120 by elastic force of an elastic member 500 to be described below so that the first anti-turning portion 440 comes in contact with the first support portion 120, and the first anti-turning portion 440 of the blocking lever 400 and the first support portion 120 of the door base 100 may be brought in contact with each other by a specific elastic member (d) made of rubber.

As the second anti-turning portion 460 is formed at another side of the blocking lever 400 and the second support portion 140 of the door base 100 is formed on the turning track of the second anti-turning portion 460, when the blocking lever 400 is turned at a predetermined angle by a car collision, the second anti-turning portion 460 comes in contact with the second support portion 140, such that the turning of the blocking lever 400 is restricted. The limit turning angle of the blocking lever 400 should be set in a range where a door is not opened even by turning of the door handle 200 and the door lever 300.

As described above, since the turning of the blocking lever 400 is restricted to fix the initial position by the contact structure of the first anti-turning portion 440 on the blocking lever 400 and the first support portion 120 on the door base 100, it is possible to prevent the stopper 420 from being interfered with the holder 220 of the door handle 200 and the guide 320 of the door lever 300 due to an unnecessary operation.

Further, since the second anti-turning portion 460 is locked to the second support portion 140 and fixed at the locked position after turning at a predetermined angle when the blocking lever 400 is turned by inertia due to a car collision through the structure of the second anti-turning portion 460 of the blocking lever 400 and the second support portion 140 of the door base 100, it is possible to prevent a door from being opened by blocking the operation-directional turning tracks of the door handle 200 and the door lever 300.

On another hand, the elastic member 500 elastically supporting the blocking lever 400 may be disposed on the hinge shaft (b) of the door base 100. The elastic member 500 may be mounted on the hinge shaft (b) of the door base 100 with one end 520 in contact with the door base 100 and another end 540 connected to the blocking lever 400.

The elastic member 500 may be various types of springs such as a torsion spring and a coil spring, and as shown in FIG. 4, the initial position of the blocking lever 400 can be fixed by disposing the elastic member 500 with the blocking lever 400 on the hinge shaft (b) of the door base 100 and connecting the elastic member to the door base 100 and the blocking lever 400 so that an elastic force is applied to the blocking lever 400.

Further, after the blocking lever 400 that has been turned by the elastic member 500 due to inertia during a car collision restricts turning of the door handle 200 and the door lever 300, the blocking lever 400 is returned to the initial position by the elastic force as the impact is gone and thus the inertia decreases, such that the door may be opened after the collision is gone.

Accordingly, it is possible to prevent a door from being opened with the blocking lever 400 turning in a collision and to allow the door to be opened with the blocking lever 400 returned to the initial position by the elastic member 500 after a collision so that a passenger may escape from the vehicle.

The present invention having this configuration provides a strong locking structure by restricting turning of the door handle 200 and the door lever 300 with the blocking lever 400 during a car collision, as shown in FIGS. 4 and 5.

That is, even when the door handle 200 deviates from the normal operation track due to deformation of a door panel in a side collision of a door, the door lever 300 firmly fixed to the door base 100 normally turns, such that it is possible to stably prevent the door from being opened due to a car collision by bringing the blocking lever 400 in contact with not only the door handle 200, but also the door lever 300.

That is, since the latch assembly is prevented from being disassembled by bringing both of the holder 220 of the door handle 200 and the guide 320 of the door lever 300 in contact with the stopper 420 of the blocking lever 400 that has been turned by inertial in a side collision of a door, it is possible to make sure that the door is prevented from being opened and to ensure safety and reliability during a car accident.

As set forth above, according to exemplary embodiments of the present invention, the problem that a door is forcibly opened by impact during a car collision, can be solved by restricting turning of a door handle and a door lever with a blocking lever that is turned by inertia during a car collision.

Further, it is possible to ensure reliability and stability during a car accident by locking the door lever firmly mounted on the door base with the blocking lever and making sure that the door is prevented from being opened, particularly, even when a door handle fails to operate along the normal turning track due to deformation of a door panel during a collision of a door.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door holding device for a vehicle, comprising:

a door handle having a first side turnably disposed on a door base and a second side in which a holder extending inwardly of the door base is formed;

a door lever hinged to the door base and having a guide engaged with the holder of the door handle so as to turn with the door handle; and a blocking lever turnably disposed on the door base by a hinge shaft and having a stopper formed to correspond to turning routes of the holder of the door handle and the guide of the door lever, wherein a first locking step, protruding in one direction, is formed to the holder of the door handle, a second locking step, protruding in one direction, is formed to the guide of the door lever, and the stopper of the blocking lever includes a first protrusion and a second protrusion corresponding to the first locking step formed to the holder of the door handle and the second locking step formed to the guide of the door lever, respectively, wherein a first anti-turning portion is formed at a first side of the blocking lever so as to fix an initial position of the blocking lever by contact with the door base, and a second anti-turning portion is formed at a second side of the blocking lever so as to restrict a turning of the blocking lever by being engaged with the door base when the blocking lever is turned at a predetermined angle in an operation direction, and wherein a first support portion is formed at the door base so as to come in contact with the first anti-turning portion in the initial position of the blocking lever, and a second support portion is formed at the door base so as to come in contact with the second anti-turning portion of the blocking lever when the blocking lever has turned at the predetermined angle.

2. The door holding device according to claim 1, wherein the first protrusion and the second protrusion of the stopper of the blocking lever are formed to cross at a predetermined angle so as to come in contact with the first locking step and the second locking step, respectively, during a car-collision.

3. The door holding device according to claim 1, wherein a mass providing inertia during a car collision is disposed on the blocking lever.

4. The door holding device according to claim 3, wherein the mass on the blocking lever is disposed at the second side of the door handle from the hinge shaft disposed through the blocking lever in order to turn the blocking lever in the same direction as an operation direction of the door handle and the door lever during a car collision.

5. The door holding device according to claim 1, wherein an elastic member, elastically supporting the blocking lever, is disposed on the hinge shaft.

6. The door holding device according to claim 5, wherein the elastic member is mounted on the hinge shaft, with a first end in contact with the door base and a second end connected to the blocking lever.

* * * * *